US005403371A

United States Patent [19]

Engdahl et al.

[11] Patent Number: 5,403,371

[45] Date of Patent: Apr. 4, 1995

[54] IRON-BASED POWDER, COMPONENT MADE THEREOF, AND METHOD OF MAKING THE COMPONENT

[75] Inventors: Per Engdahl, Nyhamnsläge; Dragan Spasic, Helsingborg; Ralf Johansson, Landskrona, all of Sweden

[73] Assignee: Hoganas AB, Hoganas, Sweden

[21] Appl. No.: 946,469

[22] PCT Filed: May 10, 1991

[86] PCT No.: PCT/SE91/00331

§ 371 Date: Nov. 10, 1992

§ 102(e) Date: Nov. 10, 1992

[87] PCT Pub. No.: WO91/18123

PCT Pub. Date: Nov. 28, 1991

[30] Foreign Application Priority Data

May 14, 1990 [SE] Sweden ..... 9001723

[51] Int. Cl.[6] ..... C22C 29/00

[52] U.S. Cl. ..... 75/230; 75/240; 75/246; 75/252; 419/14; 419/17; 419/38; 419/47

[58] Field of Search ..... 75/230, 240, 243, 246, 75/252; 419/11, 14, 38, 47, 17; 420/87, 88, 123, 122

[56] References Cited

U.S. PATENT DOCUMENTS

| | | | |
|---|---|---|---|
| 3,698,055 | 10/1972 | Holtz, Jr. et al. | 75/246 |
| 3,856,479 | 12/1974 | Iwata et al. | 428/600 |
| 3,918,923 | 11/1975 | Inoue | 29/182.5 |
| 3,977,838 | 8/1976 | Hachimoto et al. | 29/182.5 |
| 4,128,420 | 12/1978 | Esper et al. | 75/230 |
| 4,388,114 | 6/1983 | Suganuma et al. | 75/243 |
| 4,612,048 | 9/1986 | German et al. | 75/246 |
| 4,696,696 | 9/1987 | Fujita et al. | 75/246 |
| 4,743,425 | 5/1988 | Ohsaki et al. | 419/16 |
| 4,767,456 | 8/1988 | Spitzer | 75/246 |
| 4,964,908 | 10/1990 | Greetham | 75/241 |
| 4,966,626 | 10/1990 | Fujiki et al. | 75/238 |

OTHER PUBLICATIONS

International Search Report for PCT/SE91/00331 corresponds to present application.

*Primary Examiner*—Ngoclan T. Mai

*Attorney, Agent, or Firm*—Kane, Dalsimer, Sullivan, Kurucz, Levy, Eisele and Richard

[57] ABSTRACT

An iron-based powder for making wear-resisting and heat-resisting components by compacting and sintering consists of, in addition to Fe, 3–15% by weight of Mo and/or 3–20% by weight of W, the total amount of Mo+W being in the range off 3–20% by weight; 0.2–1.0% by weight of P; 0.5–1.5% by weight of C. A component is powder-metallurgically made of this iron-based powder by compacting the powder into the desired shape and sintering the compact at a temperature below about 1150° C.

9 Claims, 4 Drawing Sheets

ΔL
HV10
ΔL
HV10
800
700
600
500
400
300
200
0
-1
-2
-3
-4
-5
-6
0
0,2
0,4
0,6
0,8
1,0
% P
DENSITY
6,81
7,08
7,83
7,48

ΔL
HV10
ΔL
HV10
800
700
600
500
400
300
200
0
-1
-2
-3
-4
-5
-6
0
0,2
0,4
0,6
0,8
1,0
% P
DENSITY
6,64
7,39
8,12
8,08

ΔL
HV10
ΔL
HV10
0
-1
-2
-3
-4
-5
-6
800
700
600
500
400
300
200
0
0,2
0,4
0,6
0,8
1,0
% P
DENSITY
6,54
7,18
8,25
7,97

ΔL
HV10
ΔL
HV10
0
-1
-2
-3
-4
-5
-6
800
700
600
500
400
300
200
0
0,2
0,4
0,6
0,8
1,0
% P
DENSITY
6,59
7,45
7,97
7,86

ΔL
HV10
HV10
ΔL
0
-1
-2
-3
-4
-5
-6
800
700
600
500
400
300
200
0,2 0,4 0,6 0,8 1,0 1,2
%C
DENSITY
7,50
7,42
7,83

ΔL
HV10
HV10
ΔL
0
-1
-2
-3
-4
-5
-6
800
700
600
500
400
300
200
0,2 0,4 0,6 0,8 1,0 1,2
%C
DENSITY
7,30
7,67
7,98

ΔL
HV10
0
-1
-2
-3
-4
-5
-6
800
700
600
500
400
300
200
ΔL
HV10
0,2 0,4 0,6 0,8 1,0 1,2
%C
DENSITY
6,88
7,67
7,97

ΔL
HV10
0
-1
-2
-3
-4
-5
-6
800
700
600
500
400
300
200
ΔL
HV10
0,2 0,4 0,6 0,8 1,0 1,2
%C
DENSITY
6,85
7,50
8,25

IRON-BASED POWDER, COMPONENT MADE THEREOF, AND METHOD OF MAKING THE COMPONENT

The present invention relates to an iron-based powder for making wear-resisting and heat-resisting components by compacting end sintering.

The invention also relates to a component which is powder-metallurgically made of the inventive powder. Finally, the invention also relates to a method of powder-metallurgically making such a component.

A well-known material in wear-resisting and heat-resisting components is the so-called high-speed steel. This is characterised by relatively high contents of alloying materials which above all are carbide-forming elements, i.e. provide wear resistance but also increase the hardenability and high-temperature strength of the component. Normal alloying materials in high-speed steel are Cr, Mo, W and V, but also Co and a number of other substances can be used.

In order to achieve the purpose of high-speed steel, i.e. a powder-metallurgical material which is as hard, wear-resisting and heat-resisting as possible, a liquid phase sintering is performed after the powder has been compacted into the desired shape, whereby the component attains a high density.

The high-speed steel powder itself is usually made by water atomisation. The carbon content is selected so that a subsequent soft annealing results in a powder in which the carbon in mainly bound in the form of carbides. To give the powder a desired compressibilty, a low content of dissolved carbon is kept in the matrix.

By today's technique, a high density of the sintered component is attained in that the sintering is carried out at 1250°–1300° C. and the content of C is kept in a narrow range. Generally use is made of vacuum sintering, but sintering in reducing atmosphere with a low dew point is also applied. The sintering is carried out at these temperatures in order to provide sufficient liquid phase and thus cause shrinkage to the required high density.

The using of prior art combinations of alloying materials implies that the manufacture of a finished component, all the way from annealing to sintering, is complicated and expensive. Thus, the sintering temperature and carbon content must be carefully controlled to attain a sufficiently high density in the sintered material. The sintering temperatures used also render it impossible to perform the sintering in a belt furnace in which sintering temperatures above 1150° C. normally cannot be achieved.

The object of the present invention therefore is to provide an iron-based powder which allows simple and relatively inexpensive manufacture of wear-resisting and heat-resisting components by compacting and sintering.

In particular, it should be possible to perform the sintering operation in a belt furnace, i.e. at lower temperatures than about 1150° C.

According to the invention, this object is achieved in that the iron-based powder contains, in addition to Fe, 3–15% by weight of Mo and/or 3–20% by weight of W, the total amount of Mo+W being in the range of 3–20% by weight; 0.2–1.0% by weight of P; 0.5–1.5% by weight of C, and less than 3.0% by weight of other substances.

Preferably, the powder contains no, or just a small amount of Cr and V which are sensitive to oxidation.

The maximum total amount of Cr and/or V should be less than 2% by weight, preferably less than 1% by weight.

In a preferred composition, the powder contains 0.7–1.3% by weight of C, suitably however at least the amount which is required to form carbides with an included amount of Mo and W. Further, P can be included in the form of a phosphorous compound, suitably an iron phosphide, most preferably $Fe_3P$. Finally, the amount of Mo can be 5–14% by weight, the amount of W 5–16% by weight, and the total amount of Mo+W should be in the range of 5–16% by weight.

Owing to the amount of P included, it has appeared that the inventive powder can be liquid phase sintered at the temperatures which are normally used for sintering in a belt furnace. The sintered material also has properties similar to those of high-speed steel, despite complete or substantially complete absence of Cr and, above all, V which is known to increase the heat resistance of the sintered material.

A further object of the invention is to provide a powder-metallurgically manufactured component, and this is achieved in that the component contains, in addition to Fe, 3–15% by weight of Mo and/or 3–20% by weight of W, the total amount of Mo+W being in the range of 3–20% by weight, 0.2–1.0% by weight of P, 0.5–1.5% by weight of C and less than 3.0% by weight of other substances.

Finally, one more object of the invention is to provide a method of powder-metallurgically making iron-based components, said method being characterised in that an iron-based powder is used, which contains, in addition to Fe, 3–15% by weight of Mo and/or 3–20% by weight of W, the total amount of Mo+W being in the range of 3–20% by weight, 0.2–1.0% by weight of P, 0.5–1.5% by weight of C and less than 3.0% by weight of other substances; that the powder is compacted into the desired shape, and that the compact is sintered at a temperature below about 1150° C.

In the inventive method, first a prealloyed powder can be made which consists of Fe, Mo and/or W and, optionally, C and/or P, and then the prealloyed powder thus made can be mixed with a lubricant, such as zinc stearate, and optionally graphite and/or P before compacting. Both P and C can thus be excluded from the prealloyed powder.

Like conventional high-speed steels, the material produced according to the invention can be used for components for use in metal-cutting, which requires excellent high-temperature strength, and for components subjected to wear, e.g. in motor-car engines.

The inventive iron-based powder is preferably made by water atomisation and is suitably soft annealed in a subsequent operation. The powder thus obtained is then mixed with graphite, P, most preferably in the form of $Fe_3P$, and a lubricant. Finally, compacting is effected and also liquid phase sintering at a temperature which preferably is below about 1150° C., thereby making it possible to use a conventional belt furnace.

By using, according to the invention, P and especially $Fe_3P$, the liquid phase in the compacted material is already attained at a temperature below about 1150° C., and the compact shrinks to a high density of the component manufactured.

The addition of P gives, in addition to the liquid phase, a solution-hardening effect in the sintered component. The amount of P, especially $Fe_3P$, is at the lower limit selected so that a sufficient amount of liquid phase for attaining the high density is obtained. The upper limit for the amount of P is justified by the fact that brittle phosphides tend to be formed and reduce the strength.

The amount of C should be selected so that at least a sufficient amount of carbides for improved wear resistance is formed. However, an excess amount of C should suitably be present in order to provide a sufficiently hardenable material. The presence of C is also important since it contributes to the liquid phase.

Mo and W are added to form carbides, which improves the high-temperature strength and wear resistance. Moreover, the hardenability is increased by adding Mo and W. The lower limit of Mo and W is selected in view of the fact that a sufficient amount of carbide-forming elements is required to provide the desired wear resistance and high-temperature strength.

By means of the invention, hardnesses and densities are attained which are on a level with those of conventional high-speed steel, and thus a corresponding wear resistance and high-temperature strength are also attained.

Example 1

Iron-based powders of the compositions shown in Table 1 were produced and compacted at a pressure of 589 MPa into test bars according to Swedish standard SS 11 21 23 and sintered at 1150° C. for 1 hour, The values of quantity stated in Table 1 relate to % by weight,

TABLE 1

| Mixture | Mo | W | P | C | Fe | Fig. |
|---|---|---|---|---|---|---|
| a | 3 | 3 | 0–0.55 | 1 | balance | 1 |
| b | 5 | 5 | 0–0.5 | 1 | balance | 2 |
| c | 8 | 8 | 0–0.9 | 1 | balance | 3 |
| d | 11 | 0 | 0–0.95 | 1 | balance | 4 |

Figure 1:
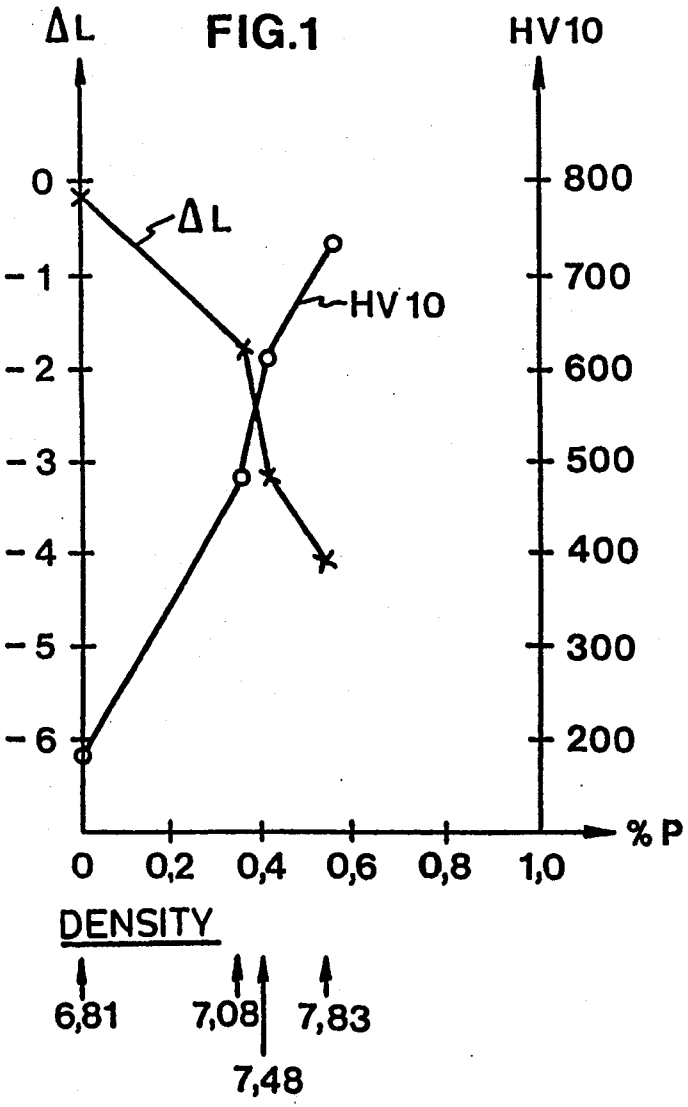
FIGS. 1–4 illustrate graphically the shrinkage L during sintering of the iron-based compacted powder along with the hardness (HV10) at room temperature, at various percentages of P.
Figure 2:
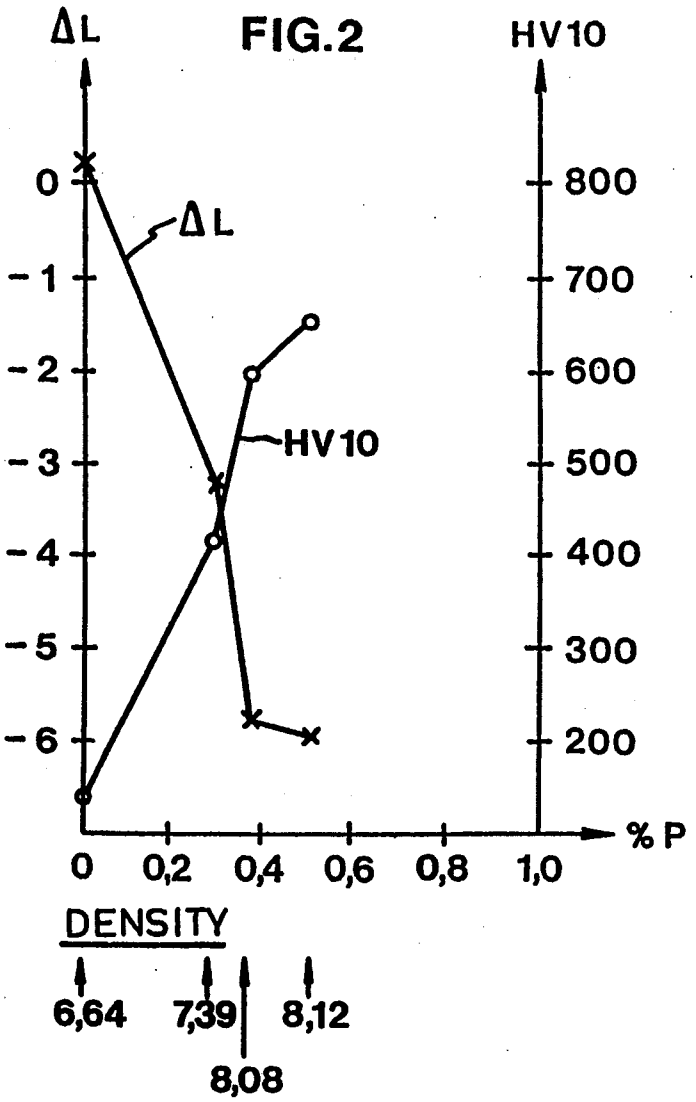
Figure 3:
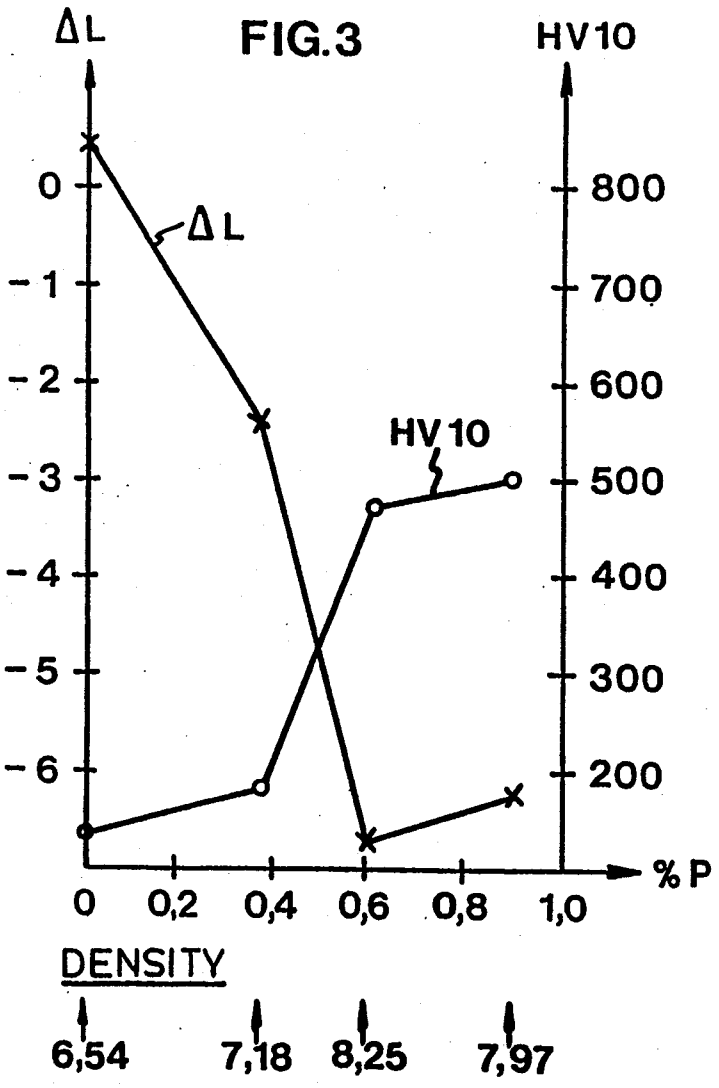
Figure 4:
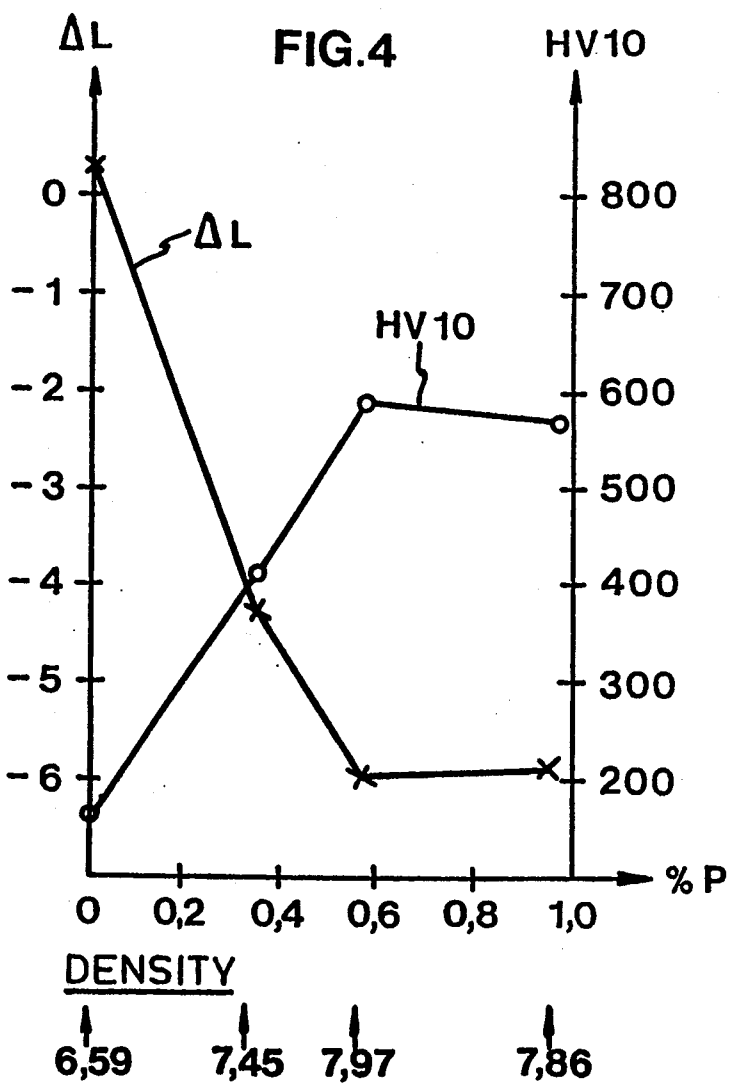

FIGS. 1–4 show the shrinkage ΔL in % during sintering of the compact, said shrinkage being a measure of the final density of the compact, as appears from the density values (g/cm$^3$) stated under the diagrams. FIGS. 1–4 also show the hardness (HV10) at room temperature of the material in the sintered compact. As is apparent, an increasing amount of P results in a substantially increasing shrinkage and increasing hardness. According to the intended field of application for the finished component, the amount of P can according to the invention be selected somewhere in the range of 0.2–1.0% by weight. The lower limit can also be set at 0.3% by weight.

Example 2

Iron-based powders of the compositions shown in Table 2 below were produced as well as compacted and sintered like in Example 1. The values of quantity stated in Table 2 relate to % by weight.

TABLE 2

| Mixture | Mo | W | P | C | Fe | Fig. |
|---|---|---|---|---|---|---|
| e | 3 | 3 | 0.6 | 0.7–1.0 | balance | 5 |
| f | 5 | 5 | 0.6 | 0.65–0.9 | balance | 6 |
| g | 8 | 8 | 0.6 | 0.55–0.95 | balance | 7 |
| h | 11 | 0 | 0.6 | 0.5–1.05 | balance | 8 |

Figure 5:
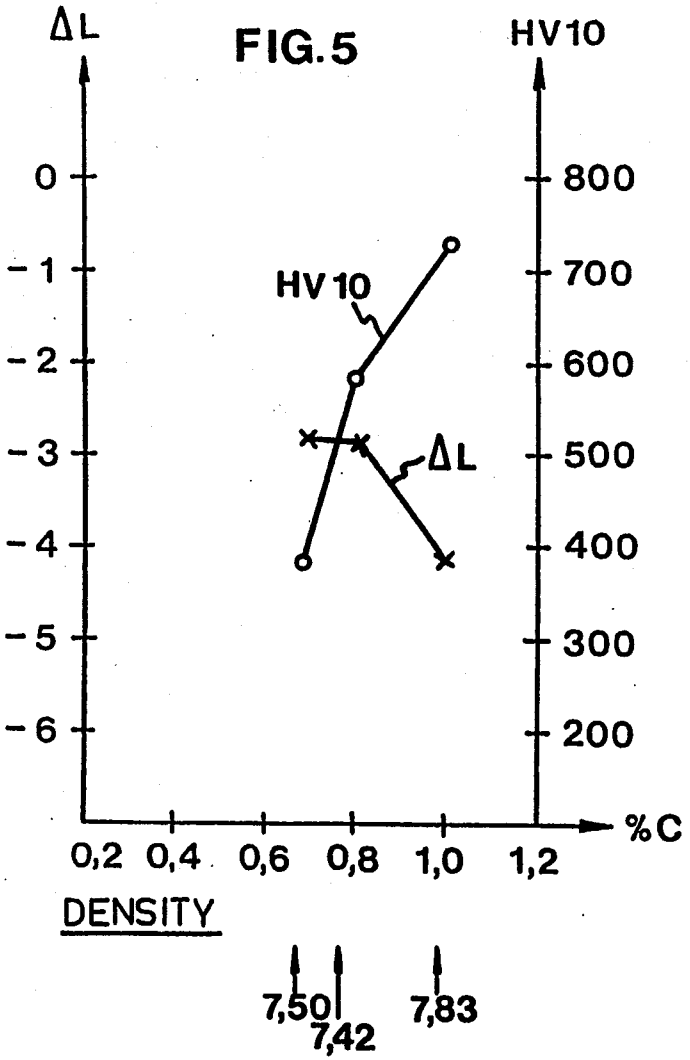
FIG. 5–8 illustrate graphically the shrinkage L during sintering of the iron-based compacted powder along with the hardness (HV10) at room temperature, at various percentages of The invention is illustrated below by a number of Examples in which reference is made to the diagrams in FIGS. 1–8 in the accompanying drawings.
Figure 6:
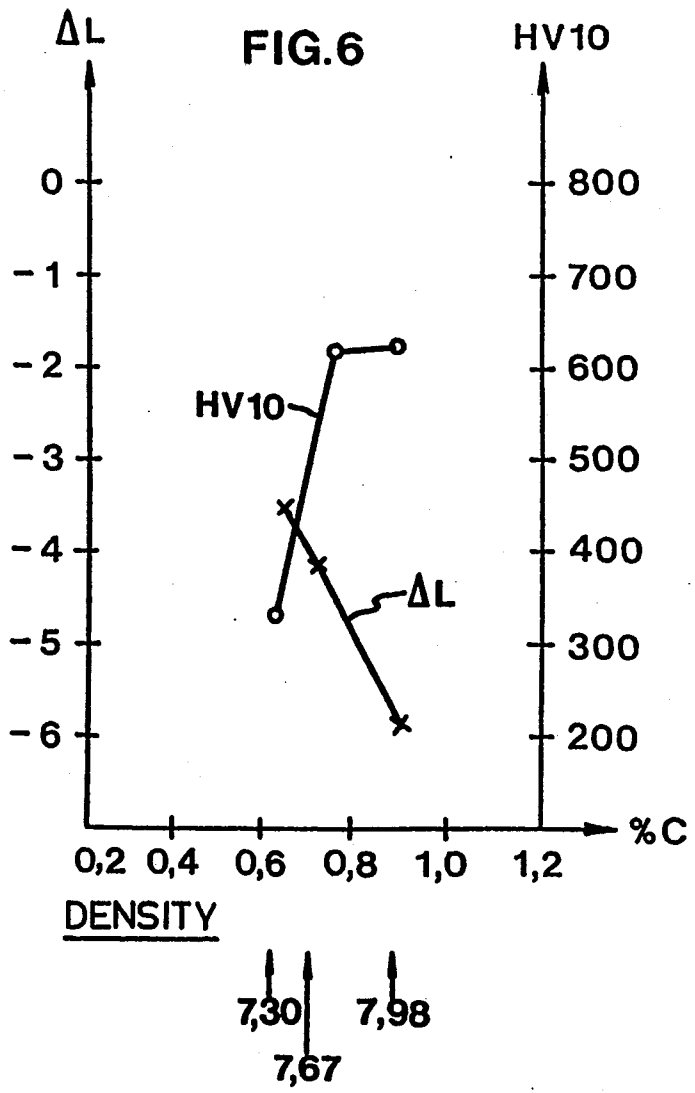
Figure 8:
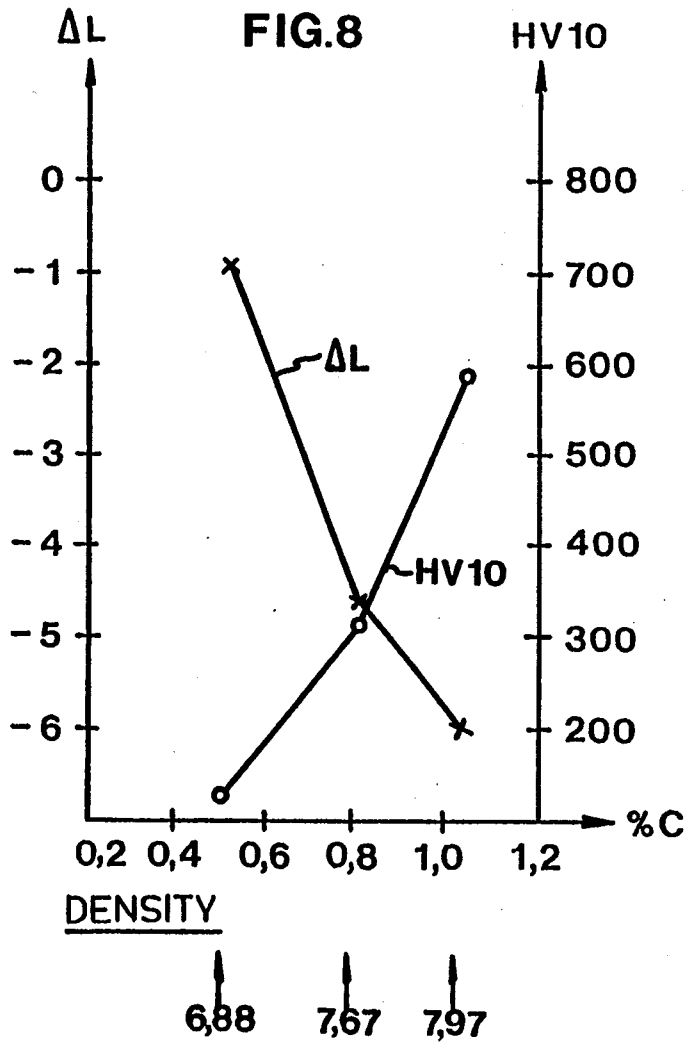
Figure 7:
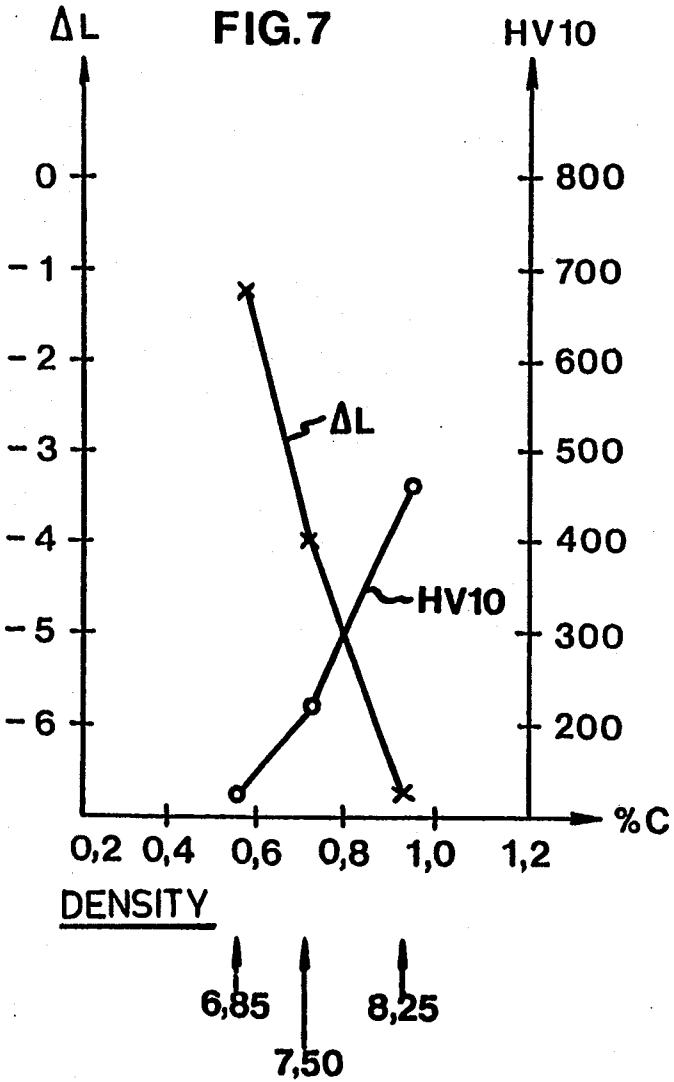

As appears from FIGS. 5–8 which also show on the one hand the shrinkage AL in % during sintering of the compact and the corresponding final density (g/cm$^3$) and, on the other hand, the hardness (HV10) at room temperature of the material in the sintered compact, a substantially increasing shrinkage and increasing hardness are obtained as the amount of C increases. According to the intended field of application for the finished component, the amount of C can according to the invention suitably be selected somewhere in the range of 0.5–1.5% by weight, most preferably in the range of 0.7–1.3% by weight.

In both Examples above, the particle size of the powder was smaller than 150 μm, the average size being 70–80 μm.

We claim:

1. Iron-based powder for making wear-resisting and heat-resisting components by compacting and sintering, consisting essentially of: Fe, 3–15% by weight Mo and/or 3–20% by weight of W, the total amount of Mo+W being in the range of 3–20% by weight; 0.2–1.0% by weight of P; 0.5–1.5% by weight of C, and whereby said powder contains Cr and/or V in a total amount which is smaller than 2% by weight.

2. The powder as claimed in claim 1 wherein phosphorous is in the form of $Fe_3P$.

3. The powder as claimed in claim 1 wherein said powder contains Cr and/or V in a total amount smaller than 1% by weight.

4. The powder as claimed in claim 1, wherein said powder essentially consists of 5–14% by weight of Mo and/or 5–16% by weight of W, the total amount of Mo+W being in the range of 5–16% by weight.

5. A method of powder-metallurgically making iron-based components, comprising the steps of using a powder set forth in claim 1, compacting said powder into a desired shape, and sintering the compacted powder at a temperature below about 1150° C.

6. The method as claimed in claim 5, characterized in that first powder is made, which consists essentially of Fe, Mo and/or W, and optionally C and/or P, and that the powder made is mixed with a lubricant and, optionally, graphite and/or P before compacting.

7. Powder-metallurgically manufactured component consisting essentially of: Fe, 3–15% by weight of Mo and/or 3–20% by weight of W, the total amount of Mo+W being in the range of 3–20% by weight; 0.2–1.0% by weight of P; 0.5–1.5% by weight of C, and whereby said powder contains Cr and/or V in a total amount which is smaller than 2% by weight.

8. The powder metallurgical manufactured component as claimed in claim 7 wherein said powder contains Cr and/or V in a total amount smaller than 1% by weight.

9. The powder metallurgical manufactured component as claimed in claim 7 wherein phosphorous is in the form of $Fe_3P$.

* * * * *